United States Patent [19]

Boren

[11] Patent Number: 4,939,854

[45] Date of Patent: Jul. 10, 1990

[54] ROTARY TRENCHING MACHINE

[76] Inventor: Gary R. Boren, 22501 Rd. 19, P.O. Box 147, Vona, Colo. 80861

[21] Appl. No.: 386,977

[22] Filed: Jul. 31, 1989

[51] Int. Cl.[5] ..... E02F 3/08

[52] U.S. Cl. ..... 37/94; 37/142 R; 37/189; 37/91; 172/42

[58] Field of Search ..... 37/80 R, 80 A, 83, 86, 37/87, 91, 94, 104, 142 R, 189, DIG. 16, DIG. 17; 172/42

[56] References Cited

U.S. PATENT DOCUMENTS

| | | | |
|---|---|---|---|
| 2,549,088 | 4/1951 | Hettelsater et al. | 37/189 |
| 2,798,314 | 7/1957 | Brite . | |
| 2,979,837 | 4/1961 | Hunter . | |
| 3,001,303 | 9/1961 | Frederick . | |
| 3,319,365 | 5/1967 | Perry et al. . | |
| 3,663,063 | 5/1972 | Johnmeyer, Sr. . | |
| 4,002,205 | 1/1977 | Falk | 37/94 X |
| 4,103,441 | 8/1978 | Flippin | 37/86 |
| 4,326,347 | 4/1982 | Ballinger | 37/94 |
| 4,346,764 | 8/1982 | Rossi | 172/42 |
| 4,360,068 | 11/1982 | Stephenson et al. . | |
| 4,396,067 | 8/1983 | Enters et al. | 172/42 |
| 4,503,630 | 3/1985 | Riley . | |
| 4,678,042 | 7/1987 | Barton et al. | 37/94 X |

*Primary Examiner*—Randolph A. Reese
*Assistant Examiner*—J. Russell McBee
*Attorney, Agent, or Firm*—Shlesinger & Myers

[57] ABSTRACT

A trenching machine that can be easily converted between push or pull type models by using same parts at the manufacturing stage, is disclosed. The machine includes a base frame having first and second surfaces, first and second ends, and sides. A motor engine and first ground engaging means are located at first end of the base frame, and second ground engaging means is located at second end thereof. A mechanism connects the motor with first ground engaging means for driving it. The second ground engaging means includes an offset portion which is positioned inside of the first ground engaging means. A digging device is cantilevered from first and second ends of the base frame, and has a portion positioned adjacent the offset portion of the second ground engaging means in front of the first ground engaging means. The base frame is open on one side and the digging device is disposed adjacent thereto. The base frame further includes a steering handle secured at the first end thereof.

19 Claims, 5 Drawing Sheets

Fig. 1
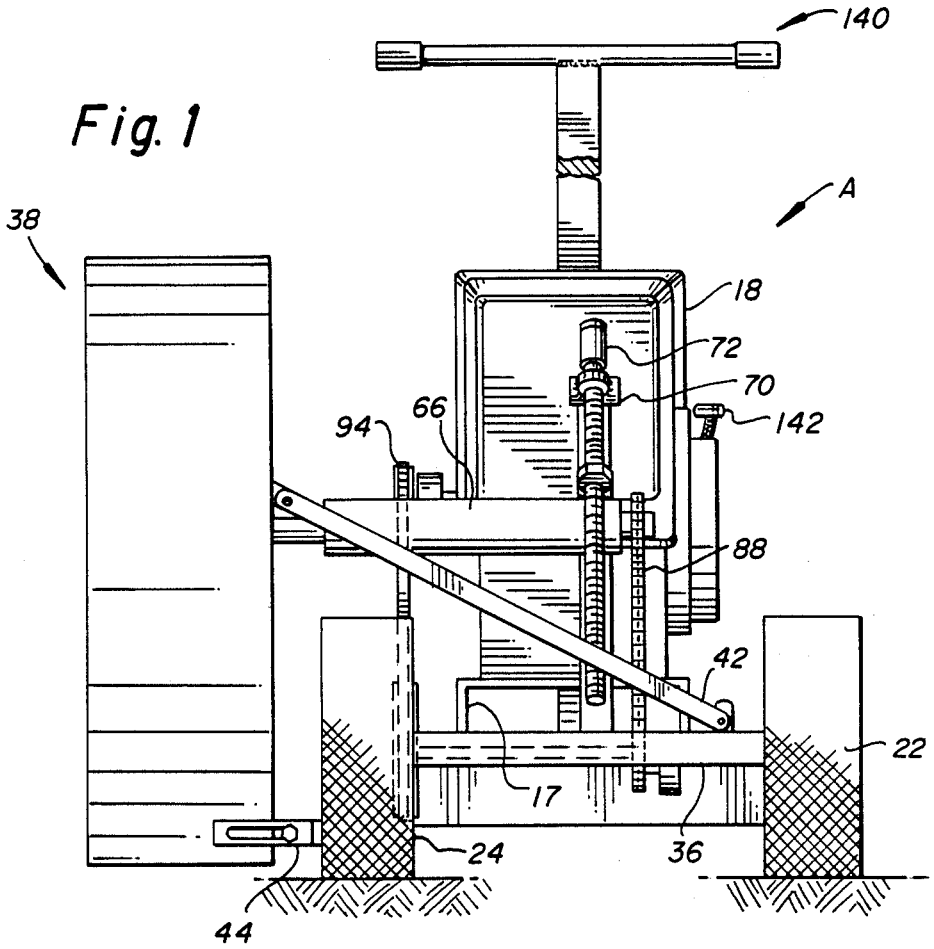
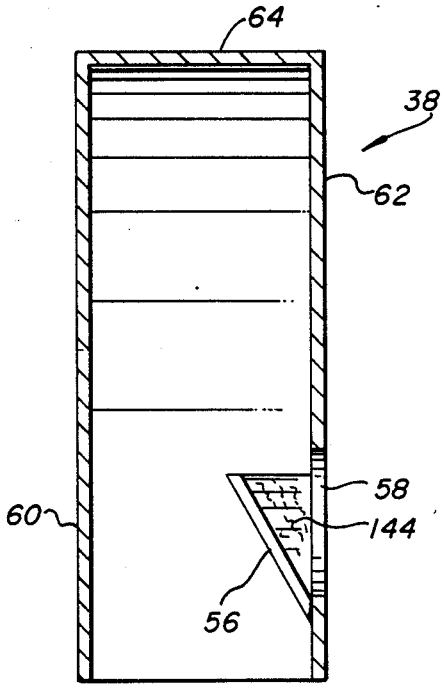
Fig. 14

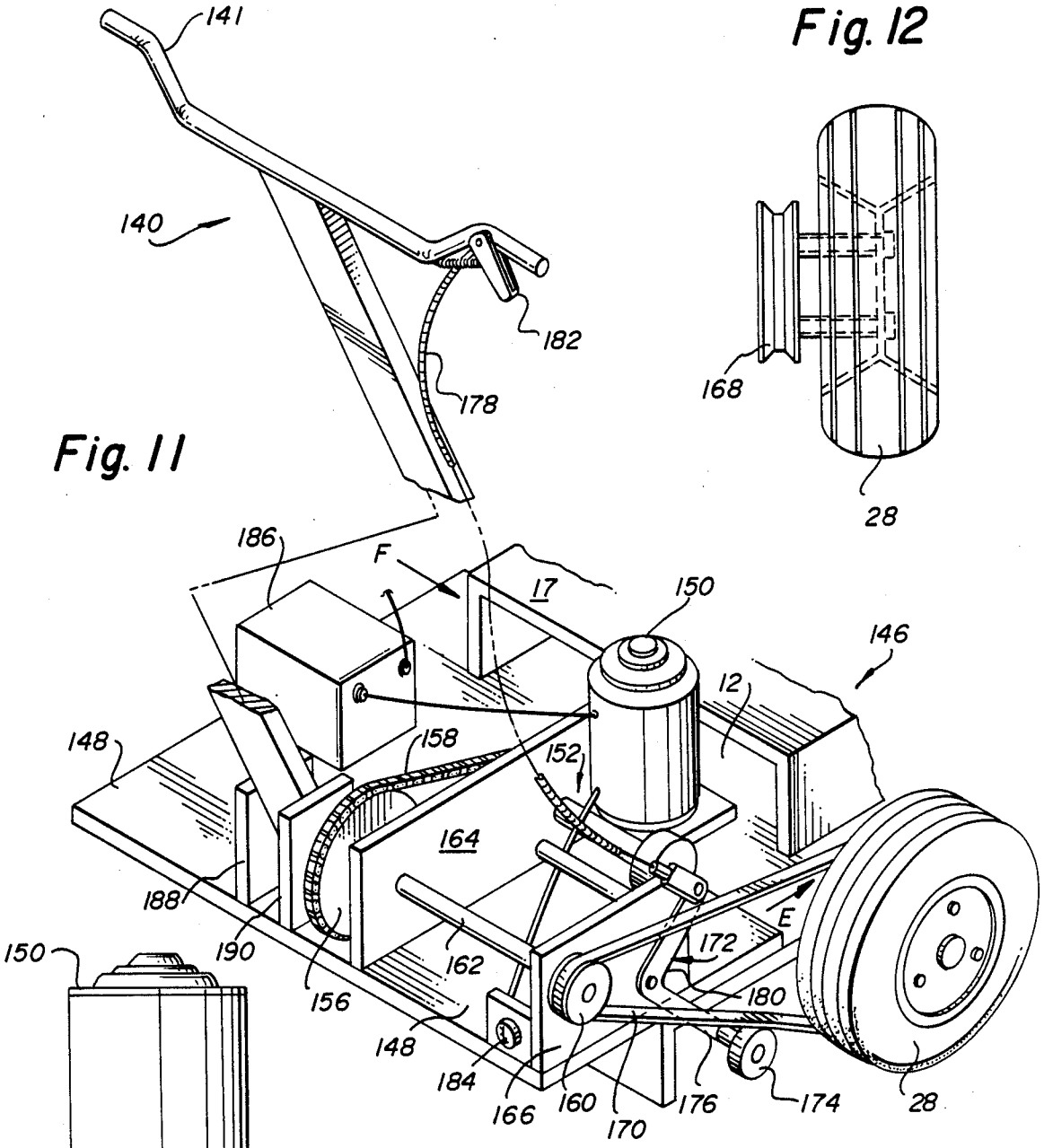
Fig. 11
Fig. 12
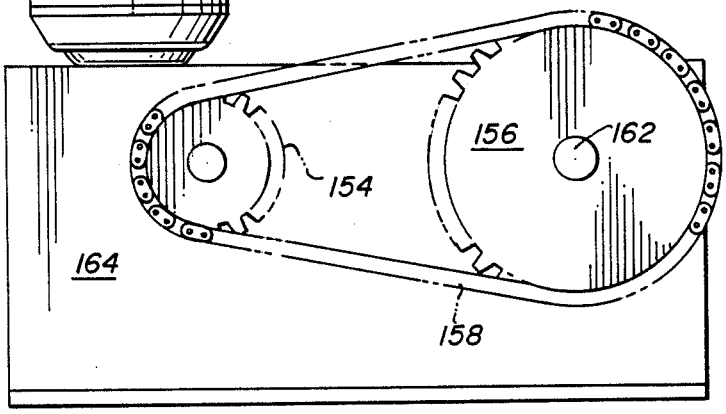
Fig. 13

ROTARY TRENCHING MACHINE

FIELD AND HISTORICAL BACKGROUND OF THE INVENTION

The present invention is directed to a trenching machine, and more particularly to a push or pull type of trenching machine.

Various digging apparatus have been proposed in the art, and examples of same are disclosed in U.S. Pat. Nos. 2,798,314; 2,979,837; 3,001,003; 3,319,365; 3,663,063; 4,360,068; and 4,503,630. The conventional digging apparatus, however, suffer from many disadvantages and there is a need in the art for a trenching machine that can be easily converted from a push to pull type of trenching machine, and vice-versa, at the manufacturing stage by using the same parts.

OBJECTS AND SUMMARY OF THE INVENTION

The principal object of the present invention is to provide a trenching machine that can be easily converted between push or pull type of trenching machine at the manufacturing stage by using the same component parts.

Another object of the present invention is provide a trenching machine that is simple in construction and requires substantially less efforts on the part of an operator in digging up a furrow, for example, due to the fact that it uses a progressive cutting action attained by orienting the cutting teeth in a precise configuration about the rotor blade.

An additional object of the present invention is to provide a trenching machine which substantially overcomes the soil resistance to the cutting action and thereby reduces the amount of strength and efforts necessary for operating the machine.

Yet another object of the present invention is to provide a trenching machine which substantially reduces the manufacturing costs by providing two different models, without the necessity of manufacturing different parts for different models.

In summary, the main object of the present invention is to provide a trenching machine which can be easily converted to a pull model using the same parts as are used in the push model.

BRIEF DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a front elevational view of the push model of the trenching machine according to the invention;

FIG. 11 is a partial enlarged end view of the trenching machine of FIG. 3, shown with the self-propelled driving unit;

FIG. 12 is a partial, enlarged view of FIG. 11 taken in direction of arrow E;

FIG. 13 is a partial, enlarged view of FIG. 11 taken in direction of arrow F; and FIG. 14 is an enlarged view taken along line 14–14 of FIG. 10.

DETAILED DESCRIPTION OF THE INvENTION

Figure 2:
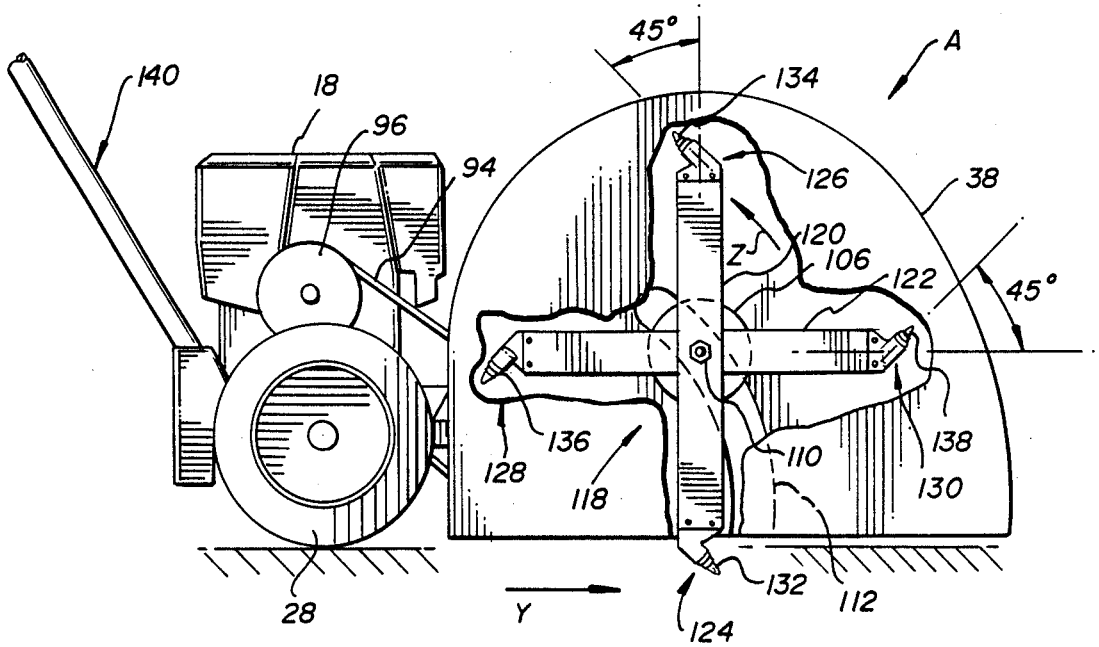
FIG. 2 is a side elevational view (in reduced dimension) of the trenching machine shown in FIG. 1, with a portion broken away to show the rotor blade.
Figure 3:
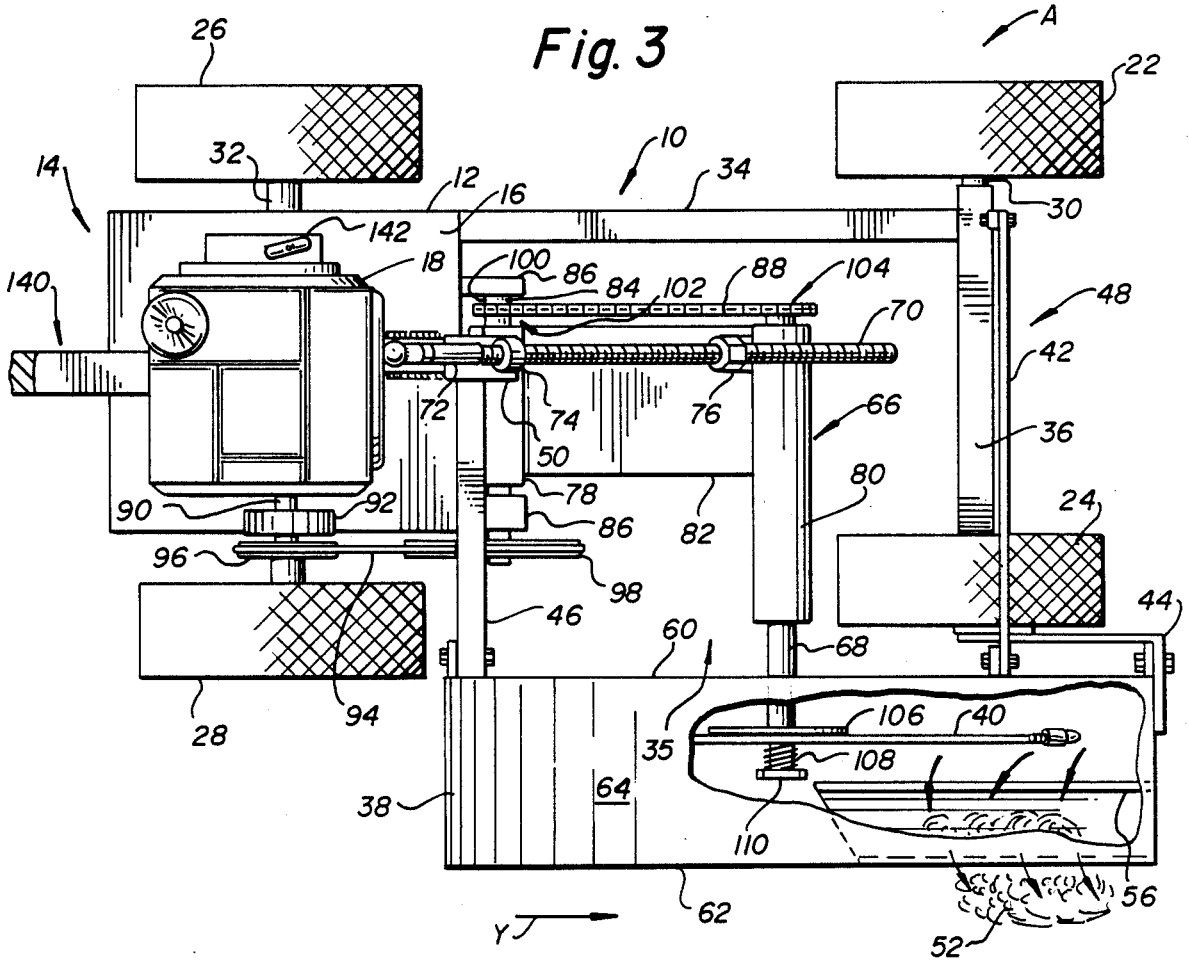
FIG. 3 is a top plan view of the trenching machine shown in FIG. 1, with a portion broken away to shown the rotor blade.
Figure 4:
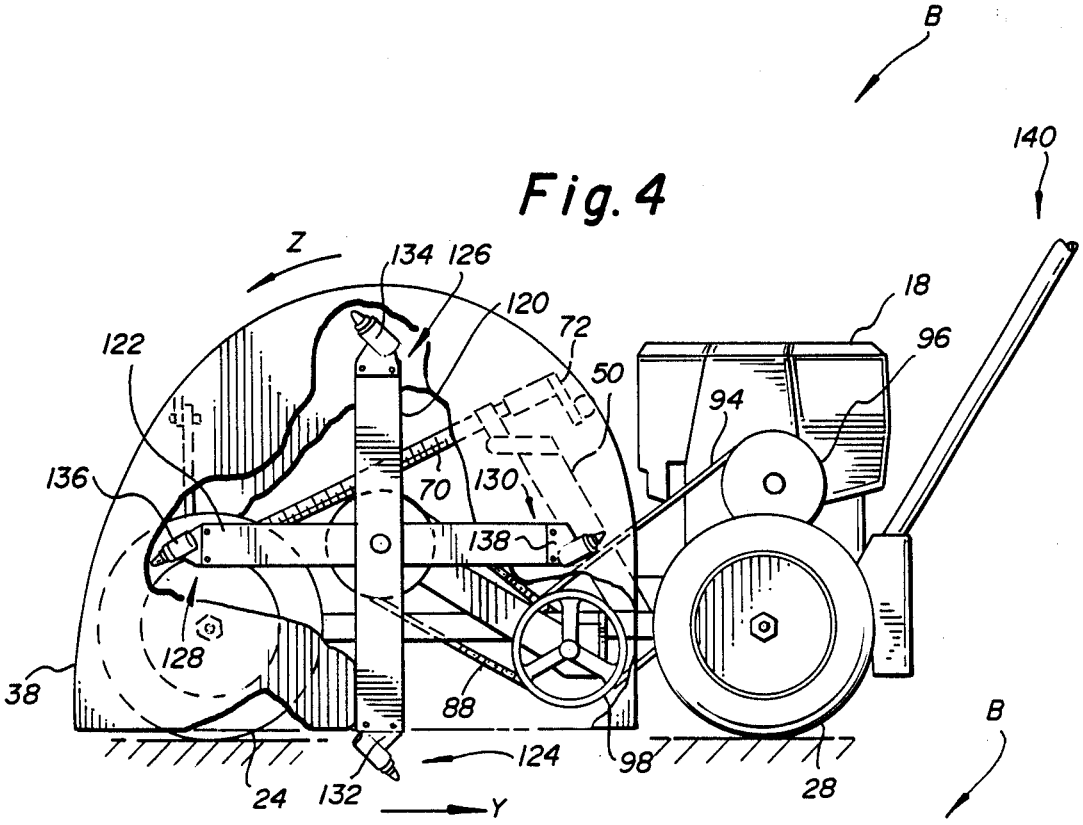
FIG. 4 is a side elevational view of the pull model of the trenching machine of the invention, with a portion broken away to show the rotor blade.
Figure 5:
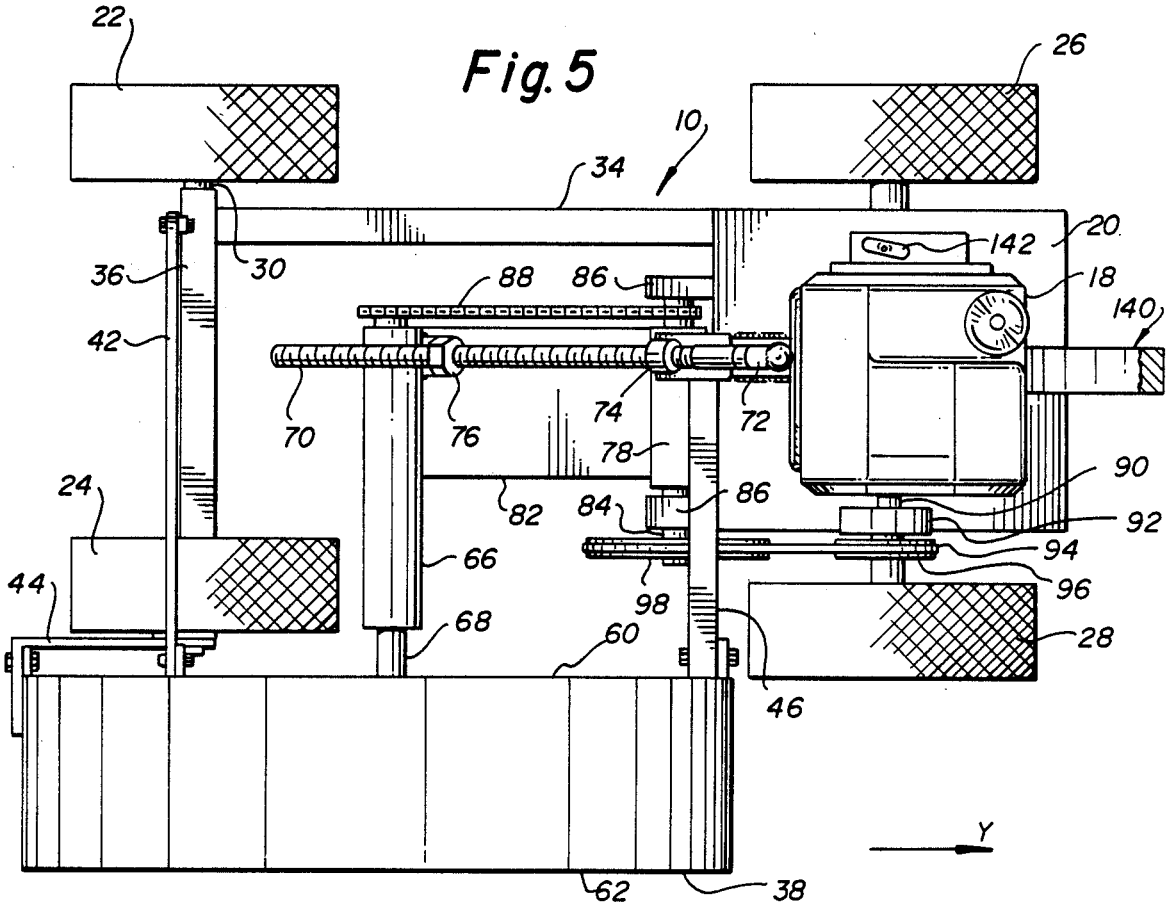
FIG. 5 is an enlarged top plan view of the trenching machine shown in FIG. 4.

In the accompanying drawings, FIGS. 1–3 disclose the push or walk-behind model of the trenching machine generally designated as A, and FIGS. 4 and 5 disclose the pull model of the trenching machine designated as B. It should be noted that at the manufacturing stage the same component parts may be used to obtain either the push model A or the pull model B. Accordingly, same reference numerals have been used throughout to designate the same parts.

As best shown in FIG. 3, trenching machine model A includes base frame 10 having the configuration of the numeral 6 or 9. The base frame 10 includes mounting platform 12 at end 14 thereof. The platform 12 includes upper surface 16 and has thereon mount 17 for supporting conventional motor engine 18 (FIG. 1). When base frame 10 is inverted about a vertical longitudinal plane of the machine so that platform 12 is now on the right hand side, as shown in FIG. 5, the upper surface 16 of platform 12 becomes the lower surface. And the lower surface 20 of platform 12 becomes the upper surface, as shown in FIG. 5, and supports motor 18 thereon.

The frame 10 further includes a pair of front wheels 22 and 24 and a pair of rear wheels 26 and 28, shown in FIG. 3. The front wheel 24 is offset from rear wheel 28, and in the pull model B (FIGS. 4–5) becomes one of the front wheels, as described below. The front wheels 22 and 24 are connected to each other by front axle 30 and rear wheels 26 and 28 are connected by rear axle 32. It would be apparent that the length of axle 30 is less than the length of axle 32, as front wheel 24 is offset and positioned inwardly on frame 10. The frame 10 includes left longitudinal support arm 34 and front arm 36. The right side 35 of the frame 10 lying opposite to support arm 34 is open and accommodates therein shroud 38 that lies in front of rear wheel 28 and adjacent offset front wheel 24.

The shroud 38 substantially encloses rotor blade 40 and is mounted to frame 10 by front brace 42 and bracket 44 and rear brace 46. Front brace 42 is connected to front arm 36 at front end 48 of base frame 10 and rear brace 46 is connected to support arm 50 mounted generally vertically on platform 12. The bracket 44 is mounted onto front axle 30.

The shroud 38 is provided to cover rotor blade 40 in order to contain the soil particles and debris 52 and to provide some measure of safety to the operator from moving blade 40. As rotor blade 40 picks up soil from the trench 54 (FIGS. 6–9), it hurls the soil and debris 52 upwardly and outwardly. The shroud 38 contains most of the soil and debris 54 and forces them to follow the internal contour of shroud 38 due to particle velocity and centrifugal force.

A deflector or baffle plate 56 is mounted on the inside of shroud 38 at outer wall 62 for collecting the debris 52 that gets deposited through opening 58 onto a place near trench 54 (FIG. 14). Preferably, the interior surface of shroud 38 is coated with a thin layer of a suitable material, such as polyurethane, to minimize wear and tear of the shroud 38. As shown in FIG. 14, the shroud 38 is bound on three sides by inner and outer walls 60 and 62 and top 64, and is open at the bottom. The baffle plate 56 is positioned on the inside of outer wall 62 that lies away from the base frame 10.

As shown in FIG. 3, rotor blade 40 is connected to swing arm 66 by a rotor shaft 68. The swing arm 66 pivots about frame 10 and is secured by a threaded rod 70 extending to a point above rotor shaft 68. The threaded rod 70 is also secured to support arm 50 and includes a handle 72 for manually rotating the threaded rod 70. The threaded rod 70 extends through screw-threaded nuts 74 and 76 mounted to support arm 50 and swing arm 66, respectively. Accordingly, it would be apparent to those of ordinary skill in the art that when handle 72 is rotated, swing arm 66 will pivot about the base frame 10.

The swing arm 66 includes two generally parallel metal tubes 78 and 80 which are connected together by a rectangular tube 82. A jack shaft 84 runs through tube 78 and is fastened to base frame 10 by pillow block bearings 86. This arrangement allows jack shaft 84 to turn freely through bearings 86 and also permits swing arm 66 to rotate about jack shaft 84. The centers of the jack shaft 84 and rotor shaft 68 are fixed and a belt drive 88 is used therebetween. Conventional sprockets (described below) would be mounted on shafts 68 and 84 over which belt drive 88 would be positioned. When swing arm 66 is pivoted, i.e., raised or lowered relative to base frame 10, the distance between the jack shaft 84 and rotor shaft 68 remains constant and, because the jack shaft 84 is fixedly mounted to base frame 10, the distance from the motor shaft 90 to jack shaft 84 also remains constant.

The power transfer from motor engine 18 to rotor 40 is accomplished in two stages. An electro-magnetic clutch 92 is mounted on the engine output shaft 90 with a V-belt 94 connected to jack shaft 84. The V-belt 94 runs between pulleys 96 and 98 mounted on motor shaft 90 and jack shaft 84, respectively. Preferably, the diameter of pulley 96 is abount one-half the diameter of pulley 98 in order to obtain a 2:1 speed reduction. At the end 100 of jack shaft 84, a belt sprocket 102 drives belt 88 which in turn drives sprocket 104 on rotor shaft 68. Thus, in the first stage the power from motor 18 is transferred to V-belt 94 and pulleys 96 and 98. In the second stage, the power is transferred to sprockets 102 and 104 an drive belt 88. The diameters of sprockets 102 and 104 are set such that a 1:8:1 speed reduction is obtained. Preferably, belt 88 is a polyurethane gear belt.

In FIG. 3, reference numerals 106 and 108 designate safety clutch plate and clutch load spring mounted on rotor shaft 68 adjacent rotor blade 40. As shown in FIG. 3, clutch load spring 108 is biased between rotor blade 40 end nut 110, and clutch plate 106 may be welded to the center of blade 40.

Figure 10:
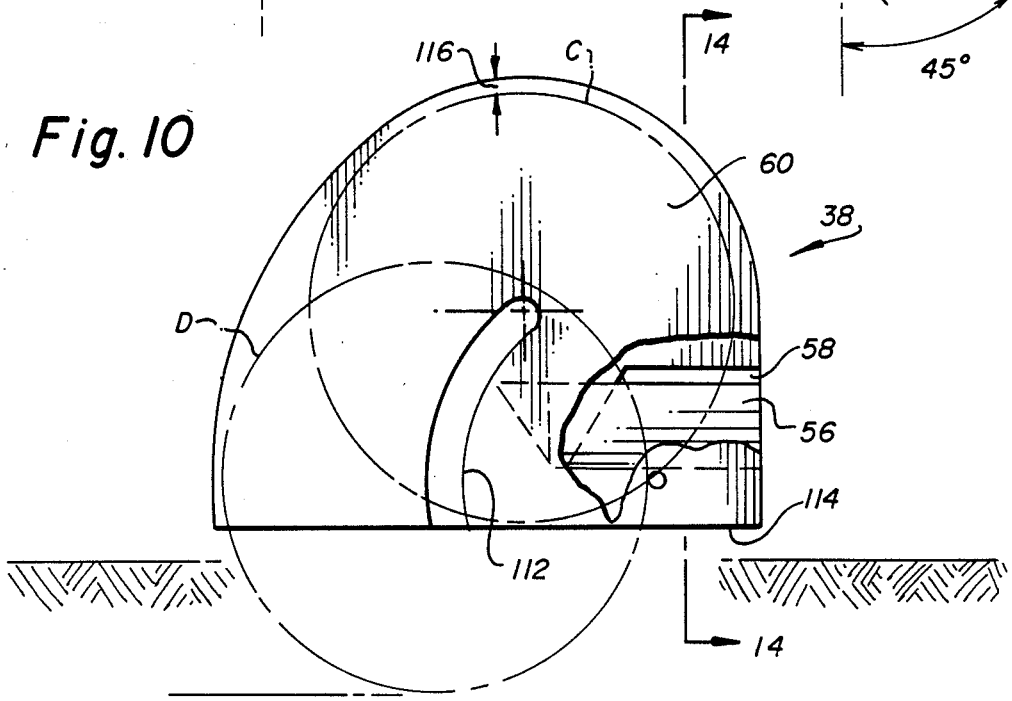
FIG. 10 is a side elevational view of the shroud enclosing the rotor blade, showing in broken lines the ground engaging position of the rotor blade, and with a portion broken away to show the deflector baffle.

As shown in FIG. 10, a curved slot 112 is provided on inner wall 60 of shroud 38 which extends from about the center of shroud 38 to bottom opening 114 thereof. The rotor shaft 68 extends through slot 112 into shroud 38 where it is connected to rotor 40, and when adjustable swing arm 66 is raised or lowered, rotor shaft 68 travels in slot 112 thereby raising or lowering rotor 40. In FIG. 10, C designates rotor path in ground non-engaging position and D designates rotor path in ground engaging position of the rotor 40. It would be apparent to those of ordinary skill in the art that by actuating handle 72 the cutting depth of trench 54 can be adjusted.

As the rotor 40 is raised or lowered, the shroud 38 must cover rotor 40 and should do so in a definable pattern. At the raised rotor position, a clearance 116 between rotor position C and shroud 38 is provided. As rotor 40 is lowered from the uppermost position (designated by C), the shroud outline is defined by the sums of the swing arm radius, rotor 40 radius, and clearance 116.

Figure 6:
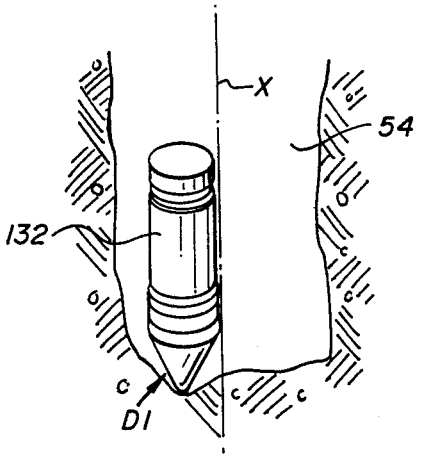
FIGS. 6—9 show the orientation of the four cutting teeth on the, rotor blade in relation to a furrow.
Figure 7:
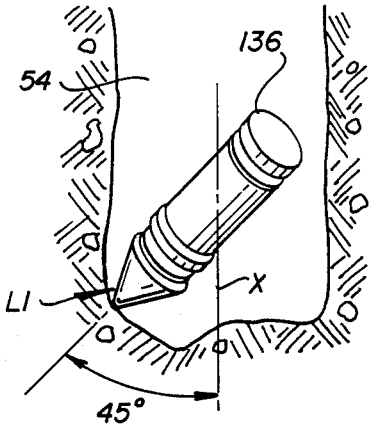
Figure 8:
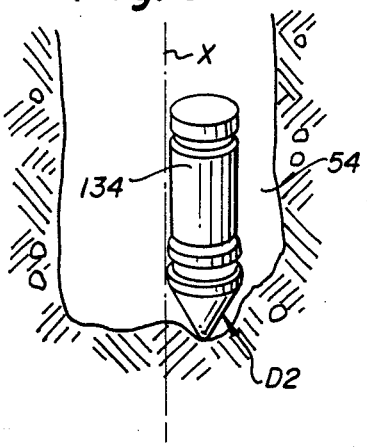
Figure 9:
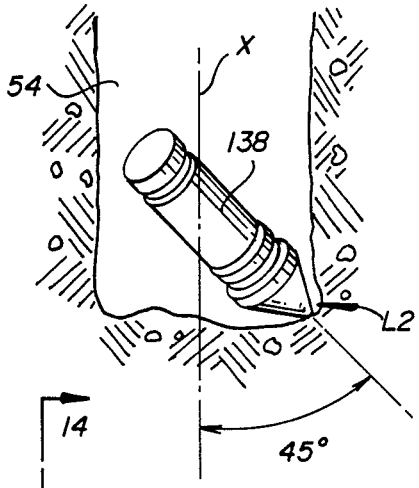

As shown in FIG. 2, rotor 40 includes cross-shaped hub portion 118 that includes arms 120 and 122 extending at right angle to each other. The free ends 124 and 126 of arm 120, and free ends 128 and 130 of arm 122, are provided with cutting teeth 132, 134, 136 and 138, respectively. FIGS. 6 and 8 show teeth 132 and 134, respectively. Similarly, FIGS. 7 and 9 show teeth 136 and 138, respectively. The teeth 132, 134, 136 and 138, are preferably separated from each other by an angular distance of about 90°. As best shown in FIGS. 6–9, the four teeth are oriented such that a progressive cutting action of trench 54 is obtained.

In particular, cutting teeth 132 and 134 extend from opposite sides of arm 120 and generally parallel thereto (see FIGS. 6 and 8 where X designates the central longitudinal plane of hub 118.) Cutting teeth 136 and 138 extend at skew angles from the opposite sides of arm 122. Preferably, the skew angle of teeth 136 and 138 is about 45°. In addition, all teeth 132, 134, 136 and 138 are oriented such that they extend at about 45° from the longitudinal axes of respective arms 120 and 122, see FIG. 2. The arms axes themselves extend at 90° to each other.

As shown in FIGS. 6–9, cutting teeth 132 and 134 cut trench 54 in a vertical direction and teeth 136 and 138 cut trench 54 in lateral directions.

Preferably, the rotor 40 is made from a steel or aluminum alloy and the cutting teeth are bullet shaped with carbide tips. A conventional handle 140 or the like is mounted at rear end 14 of base frame 10 for steering the trenching machine. It should be noted, however, that other conventional coupling means may be mounted instead of handle 140, if the trenching machine is going to be pulled by, for example, a tractor or the like.

FIGS. 4 and 5 show the pull model B of the trenching machine. This model is obtained by inverting base frame 10, i.e., obtaining mirror-image, and turning the motor engine 18 around and placing it on lower surface 20 of platform 12, which is now the top surface of platform 12. The rotor 40, adjustable swing arm 66 and related components are then mounted in front of the platform as shown in FIG. 5. The front wheels 22 and 24 of push model A (FIG. 3) now become the rear wheels, and rear wheels 26 and 28 of the push model A now become the front wheels. It should be noted that no new parts, or any adjustments in the parts shown in FIG. 3, are needed in order to convert from push model A to pull model B, except that mount 17 would have to be provided on surface 20 of platform 12 in order to mount motor engine 18 thereon. It should be apparent that the base frame 10 has be inverted before motor engine 18, adjustable swing arm 66 and rotor 40 and shroud 38 are mounted on the frame. It should further be noted that regardless of the push or pull type model, the direction of travel and the rotational direction of rotor 40, indicated by arrows Y and Z, respectively, remain the same. Thus, it is not necessary to reverse the rotation motor 18.

Although not shown, a power source for motor engine 18, such as a battery, can be mounted at a convenient location on platform 12.

FIG. 11 shows the self-propelled driving unit 146, that can be used with either models A and B. The driving unit 146 would normally be positioned at end 14 of frame 10 on platform 12 and includes mounting bracket 148 welded or bolted onto the platform 12. A motor 150 includes a gear unit 152 for driving toothed wheel 154 (FIG. 13). Another toothed wheel 156, having a substantially larger diameter than wheel 154, is in driving engagement with wheel 154 by drive chain 158. Preferably, motor 150 turns at 95 rpm, and wheels 154 and 156 each have thirteen (13) and thirty-six (36) teeth, respectively.

A pulley 160 is connected with wheel 156 by axle 162. As shown in FIG. 11, pulley 160 and wheel 156 are oppositely located adjacent vertical walls 164 and 166 of bracket 148. Pulley 160 is, on the other hand, in driving engagement with drive pulley 168 mounted on the inside of one of rear wheels of the trencher lying adjacent driving unit 146 (FIG. 12). For example, in model A shown in FIG. 3, driving pulley 168 Would be mounted on the inside of wheel 28. A drive belt 170 runs between pulleys 160 and 168. Preferably, the perimeter length of belt 170 is such that upon mounting it on pulleys 160 an 168, the belt 170 is not taut and freely slides thereon.

A generally V-shaped idler cam 172 is pivotably mounted on wall 166 of bracket 148. A drive belt tightening wheel 174 is mounted on an arm 176 of cam 172, and cable 178 is mounted on the other arm 180 thereof. The cable 178, on the other hand, is linked to a spring-loaded lever 182 mounted on handle bar 141 of the trenching machine The wheel 174 is oriented along the vertical plane of belt 170, such than when cam 172 is pivoted upwardly by actuating lever 182, wheel 174 engages the belt 170 and tightens it between pulleys 160 and 168. The belt 170 can be loosened by disengaging wheel 174 done by pivoting cam 172 downwardly. In FIG. 11, numeral 184 designates a potentiometer provided for controlling the speed of motor 150, so as to obtain a forward speed of trenching at about between 10–30 ft./minute.

The operation of driving unit 146 is as follows. Normally, drive belt 170 would be riding freely in the corresponding grooves of pulleys 160 and 168, and even when motor 150 has been turned on, the rotation of pulley 160 will not cause pulley 168 to rotate. Accordingly, rear wheel 28, for example, will not rotate. In this position, the operator would need to apply force to push or pull the trenching machine. However, when lever 182 is actuated by the operator, i.e., squeezed, it will cause cam 172 to pivot upwardly thereby bringing wheel 174 into tight engagement with belt 170. Once cam 172 has been pivoted upwardly to a sufficient degree so as to cause the rotating belt 170 to be tightened between pulleys 160 and 168, rotating belt 170 will begin to rotate pulley 168 thereby driving wheel 28. It should be noted that cam 172 will stay in this upward position so as long as lever 182 is kept in the actuated position. Once lever 182 is released, cam 172 will pivot downwardly to assume its original position and wheel 172 will no longer be in engagement with drive belt 170. As a result, belt 170 again will slacken and slide freely on pulleys 160 and 168, and wheel 28 will no longer rotate.

Preferably, motor 150 is a 12 volt D.C. motor which turns at 95 rpm thereby providing a forward speed of about 30 feet/minute. As shown in FIG. 11, a 12 volt battery 186 provides necessary power for motor 150. The charging current for battery 186, on the other hand, may be provided from a built-in alternator (not shown) in motor engine 18.

In FIG. 11, numerals 188 and 190 designate mounting brackets for handle 140. As evident from this Figure , the driving unit 146 may be mounted on one side of handle brackets 188 and 190, and battery 186 may be mounted on the other side thereof. Although not shown, it would be desirable to mount a suitable safety cover over driving unit 146 for aesthetics and to protect the operator from any injuries due to the moving parts of unit 146.

USE AND OPERATION

In using either the push model A or pull model B, once the trenching machine is appropriately positioned alongside the intended location of a furrow or trench, the adjustable swing arm 66 would be lowered by actuating depth adjustment handle 72 to a desired degree. The motor engine 18 would then be started by, for example, pulling handle 142. The trenching machine would then be pulled or pushed, depending upon the type of the model, in generally a straight line alongside the location of the trench, such that rotor blade 40 begins to dig into the ground.

As the rotor 40 turns about the axis of rotor shaft 68, only one of the cutting teeth 132 and 134 first contacts the ground, as teeth 136 and 138 are skewed relative to the ground surface. It should be noted that only one of the teeth 132 and 134 contacts the ground at one time, as they are positioned 180 ° from each other and their tips point in opposite directions. Accordingly, as tooth 132 comes doWn to engage the ground, for example, tooth 134 at that point would be moving away from the ground. Similarly, teeth 136 and 138 are also positioned 180 from each other with their tips also pointing in opposite directions. Therefore, even though tooth 136 cuts into the trench laterally on one side L1, tooth 138 cuts into laterally on the opposite side L2 of the trench (FIGS. 7 and 9). That is, between teeth 136 and 138, only one cuts into the trench at one time. It should be noted that tooth 132 cuts into the depth of the trench at bottom left portion D1 of the trench, and tooth 134 cuts into the bottom right portion D2 of the trench (FIGS. 6 and 8). In summary, teeth 132 and 134 progressively cut into the depth of the trench 54 and teeth 136 and 138 cut into the Width of the trench 54.

It should be noted that the force needed to overcome the soil resistance to the cutting teeth is kept at a minimum by positioning the teeth at an angular distance of about 90 ° from one another. In other words, as one of the four teeth 132, 134, 136, and 138, begins to dig into the ground, the other tooth which is 90 ° ahead of this one tooth, would be exiting the trench. In effect, as one tooth begins to dig into the ground, the tooth which is 90 ° ahead of it, is essentially coming out of the trench. In this manner, only one tooth effectively cuts into the trench at one time. Preferably, cutting teeth 132 and 134 are ¼"longer than teeth 136 and 138, in order to equalize the earth moving load of teeth 132 and 134 with respect to teeth 136 and 138.

As noted above, the soil and debris swirls up into the shroud 38 and gets collected into pocket 144 made by shroud wall 62 and baffle 56, and from there it gets exited through opening 58. As the trenching machine is moved along the trench, a pile of debris or soil is deposited alongside the trench.

While this invention has been described as having preferred designs, it is understood that it is capable of further modifications, uses and/or adaptations of the invention, and including such departures from the present disclosure as come within known or customary practice in the art to which the present invention pertains, and as may be applied to essential features hereinbefore set forth, and fall within the scope of the invention or the limits of the claims appended hereto.

What I claim is:

1. A push or pull type of trenching machine, comprising:

(a) base frame means;

(b) said frame means having a first surface and a second surface;

(c) said frame means having first and second ends and sides;

(d) said first end including motor means and a first ground engaging means;

(e) means connecting said motor means to said first ground engaging means for driving said first ground engaging means;

(f) said second end including a second ground engaging means;

(g) digging means cantilevered from said first and second ends of said frame means;

(h) said second ground engaging means including an offset portion positioned inside of said first ground engaging means;

(i) said digging means having a portion positioned adjacent said offset portion of said second ground engaging means and in front of said first ground engaging means;

(j) said frame means being open on one side thereof;

(k) said digging means disposed adjacent said open side of said frame means;

(l) steering means secured to said frame means at first end thereof; and (m) said first and second surfaces each including means for mounting said motor means on one of said first and second surfaces, depending upon the push or pull position of the trenching machine.

2. The trenching machine of claim 1, wherein:

(a) said frame means includes means for inverting between a first push position and a second pull position of the trenching machine.

3. The trenching machine of claim 1, wherein:

(a) said digging means has a first ground engaging position and a second ground non-engaging position.

4. The trenching machine of claim 3, and including:

(a) swing arm means cooperating with said digging means for causing said digging means to assume said first or said second position.

5. The trenching machine of claim 1, wherein:

(a) said digging means includes rotary blade means; and (b) said digging means includes shroud means substantially covering said blade means.

6. The trenching machine of claim 5, wherein:

(a) said blade means includes a generally cross-shaped central portion; and (b) said blade means includes tooth means mounted adjacent at least one of the tips of said crossshaped central portion.

7. The trenching machine of claim 6, wherein:

(a) said tooth means are mounted adjacent a plurality of tips of said cross-shaped central portion.

8. The trenching machine of claim 7, wherein:

(a) said central portion includes first and second generally planar surfaces; and (b) said central portion includes first and second arms oriented generally at right angle to each other.

9. The trenching machine of claim 8, wherein:

(a) a first tooth means extends generally parallel to the plane of said first surface of said central portion.

10. The trenching machine of claim 9, wherein:

(a) a second tooth means extends at a skew angle from said first surface of said central portion.

11. The trenching machine of claim 10, wherein:

(a) a third tooth means extends in a plane generally parallel to the plane of said second surface of said central portion.

12. The trenching machine of claim 11, wherein:

(a) a fourth tooth means extends at a skew angle from said second surface of said central portion.

13. The trenching machine of 12, wherein:

(a) said skew angle for said fourth tooth means is about 45 °.

14. The trenching machine of claim 10, wherein:

(a) said skew angle for said second tooth means 20 is about 45 °.

15. The trenching machine of claim 5, wherein:

(a) said shroud means includes an opening on one side thereof; and (b) said shroud means includes an internal baffle means disposed adjacent said opening for directing the flow of debris to the exterior via said opening.

16. A push or pull type of trenching machine, comprising:

(a) base frame means invertible between a first push position and a second pull position of the trenching machine;

(b) rotary digging means having a first ground engaging position and a second ground non-engaging position;

(c) swing arm means cooperating with said rotary digging means for causing said rotary digging means to assume said first or said second position;

(d) swing arm means including means for adjusting digging depth of said rotary digging means;

(e) means for rotating said rotary digging means; and (f) means for mounting said rotary digging means on the same side of the trenching machine regardless of whether the trenching machine assumes said first push position or said second pull position.

17. The trenching machine of claim 16, wherein:

(a) said digging means includes a generally cross-shaped hub portion and a plurality of tooth means mounted adjacent the perimeter of said hub portion; and ( b) one of said tooth means extends at a skew angle from the vertical plane of said hub portion.

18. The trenching machine of claim 17, wherein:

(a) another one of said tooth means extends about a plane generally parallel to the plane of said hub portion.

19. The trenching machine of claim 17, and including:

(a) shroud means substantially covering said digging means;

(b) said shroud means including an opening on one side thereof;

(c) said shroud means including internal baffle means for directing the flow of debris to the exterior through said opening; and (d) driving means for self-propelling the trenching machine.

* * * * *